US005250012A

United States Patent [19]

Meredith

[11] Patent Number: 5,250,012

[45] Date of Patent: Oct. 5, 1993

[54] RUNNING SURFACE FOR TREADMILL WITH TRAMPOLINE-LIKE SURFACE

[75] Inventor: Jeffrey O. Meredith, Houston, Tex.

[73] Assignee: Morris Glenn Whitcomb, Jr., Baytown, Tex. ; Trustee

[21] Appl. No.: 657,439

[22] Filed: Feb. 19, 1991

[51] Int. Cl.[5] ..... A63B 22/02

[52] U.S. Cl. ..... 482/54

[58] Field of Search ..... 272/65, 69, 70; 198/847; 482/54, 51

[56] References Cited

U.S. PATENT DOCUMENTS

| | | | |
|---|---|---|---|
| 2,370,990 | 3/1945 | Nissen | 272/65 |
| 3,095,947 | 7/1963 | Beaulaurier | 272/65 |
| 4,509,510 | 4/1985 | Hook | 272/69 |
| 4,614,337 | 9/1986 | Schonenberger | 272/69 |
| 4,938,473 | 7/1990 | Lee et al. | 272/69 |

*Primary Examiner*—Stephen R. Crow

*Attorney, Agent, or Firm*—Pravel, Hewitt, Kimball & Krieger

[57] ABSTRACT

An improved trampoline-like belt for a treadmill includes an endless belt adapted to travel between end-supporting members. The belt is formed of a material which is resilient across at least a portion of its width to provide the resiliency necessary without springs to impart a trampoline-like sensation to a subject walking or running on the belt. The improved belt is designed for use with a treadmill where the belt is generally folded into parallel sections, the upper surface of which is adapted to form an exercising surface.

13 Claims, 3 Drawing Sheets

RUNNING SURFACE FOR TREADMILL WITH TRAMPOLINE-LIKE SURFACE

BACKGROUND OF THE INVENTION

This invention relates to treadmills with trampoline-like surfaces and, more particularly, to an improved mat or belt which eliminates the use of springs normally used for imparting the necessary resiliency for such an apparatus.

Treadmills utilize an endless moving belt that allows an individual to walk, jog or run in place. Treadmills are useful not only for exercise, but for rehabilitation programs and medical testing such as the "stress test" which is commonly used. There is a demand for treadmills in indoor health clubs since many clubs are not able to build a running track and a treadmill provides the capability of a well-rounded exercise program.

Most treadmills are formed with a thin, endless belt which travels over a supporting surface so that the belt can withstand the weight of the individual using it. It has been found that for these types of devices, the belt has a tendency to wear because of frictional contact between the supporting surface and the belt. Further, the rigid surface beneath the belt can cause shin splints or other stress-related injuries to the legs of the user. The value of treadmills of this design is limited for rehabilitation purposes because of the impact on the legs of the users.

It has been found that a treadmill which utilizes a trampoline-like surface with a built-in resiliency reduces impact on the legs of the users to the point where such a machine can be used as a primary therapeutic aid for rehabilitation from leg injuries. Such a treadmill is also useful for normal exercise because it significantly reduces the wear and tear on the legs of the user.

U.S. Pat. No. 4,548,405, which issued on Oct. 22, 1985, is directed to such an apparatus where a treadmill is shown and described which has a trampoline-like surface for providing the advantages described above. That machine has an endless belt which is connected along its edges through a series of springs to carrier rails located outwardly of both edges of the belt. The springs and associated carriers would move along the rail and allow the mat surface to move as the runner was exercising on the treadmill. The springs would impart a resiliency to the belt and lessen the impact on the legs of the runner using the machine.

An improved design for the treadmill with the trampoline-like surface was shown and described in U.S. Pat. No. 4,938,473 which issued on Jul. 3, 1990. In that patent, a number of improvements were described, including the use of a pair of springs spaced at an angle between each carrier and the belt in order to provide greater lateral support and stability for the belt.

It has been found that belts which utilize springs, even with the improved design shown in U.S. Pat. No. 4,938,473, have a tendency to be unstable and cause troublesome wear in that when a runner is using the machine the springs will flex unevenly at various points along the length of the belt. Further, springs have been found to add additional weight and expense to the machine itself. While the machine shown in the two patents mentioned above has proven to be successful, it was felt that elimination of the spring would improve the structure and performance of the apparatus.

SUMMARY OF THE INVENTION

An improved belt for a treadmill with a trampoline-like surface has been developed which solves the problems mentioned above by eliminating the need for springs to impart resiliency to the belt. The improved trampoline-like belt is formed of an endless belt adapted to travel between end-supporting members. The belt is formed of a material which is resilient across at least a portion of its width to provide the resiliency necessary without additional springs to impart a trampoline-like sensation to a subject walking or running on the belt.

In a preferred embodiment, the belt is formed with a substantially non-resilient center and edge sections, with a resilient section between the non-resilient sections. The belt can be formed by laminating a number of thin layers of a resilient material such as butyl rubber. In order to form the non-resilient sections, one or more layers of nylon mesh are laminated between layers of the resilient material. The layers of resilient material can be joined at different locations along the length of the belt so that the belt is essentially seamless when completed. Alternatively, the belt can be formed entirely of resilient material such as butyl rubber to achieve the same results.

The belt is used with a treadmill frame where the upper surface of the belt is adapted to form an exercising surface. The frame includes supports at each end of the belt so that the belt can travel between two points. The supports also include guide rails spaced apart from the lateral edges of the belt so that a series of carriers can be used to connect the belt to the rails and travel with the belt along the guide rails as the belt moves along its path. The carriers can be attached to the belt through a series of reinforced openings formed near the lateral edges of the belt.

In this way, springs which were located in prior art machines between the lateral edges of the belt and the guide rails have been eliminated to provide a simpler and more effective machine for achieving the advantageous results described above.

BRIEF DESCRIPTION OF THE DRAWINGS

For a better understanding of the invention, reference should be made to the detailed description of exemplary embodiments set forth below, considered in conjunction with the appended drawings, in which.

DETAILED DESCRIPTION OF EXEMPLARY EMBODIMENTS

Figure 1:
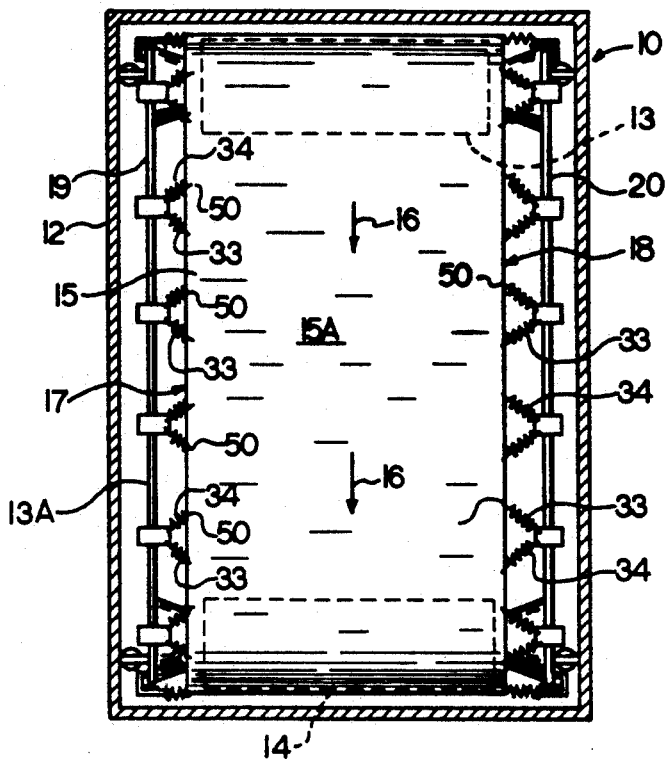
FIG. 1 PRIOR ART
FIG. 1 is a top plan view of the trampoline-like surface and support frame of the apparatus in the prior art.
Figure 2:
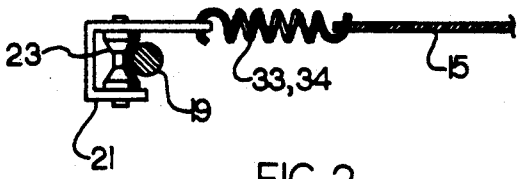
FIG. 2 PRIOR ART
FIG. 2 is a plan view of a portion of the prior art machine of FIG. 1 where of a spring connects the belt through a carrier to a guide rail located outwardly from one of the edges of the belt.
Figure 3:
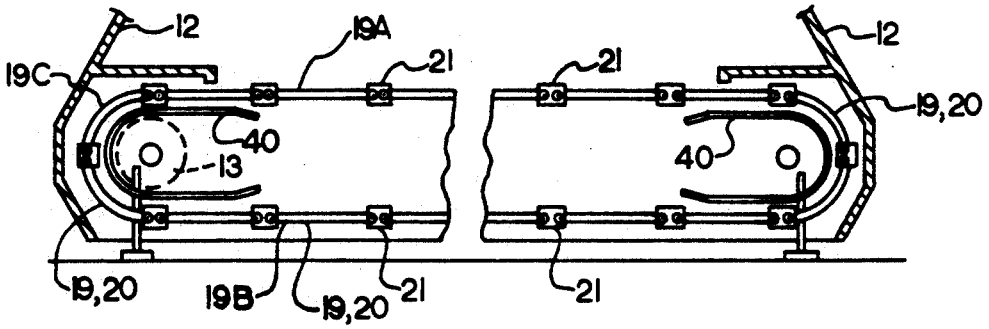
FIG. 3 PRIOR ART
FIG. 3 is a side plan view of the treadmill with the trampoline-like surface of FIG. 1.

FIGS. 1-3 show a treadmill which utilizes a belt, spring and guide rail design to provide with a trampoline-like surface, over which the belt of the present invention is an improvement. Referring specifically to FIG. 1, a treadmill 10 has a frame 12 which supports a pair of roller assemblies 13,14. An endless belt 15 is supported so that a runner, jogger or walker can stand on the belt surface 15A. As the belt moves in the direction shown by the arrows 16, the subject can move his or herself along a typical jogging, walking, running gait and yet remain in the same position as with typical treadmills.

However, with this machine, the trampoline-like surface 15A is cushioned as a result of the peripheral edge portion 17,18 of the belt 15 being supported by a plurality of spring assemblies described below.

A pair of continuous guide rails 19,20 are provided on opposite edge portions of the belt 15 and spaced laterally from the rails as shown in FIG. 1. The rails include top 19A and bottom 19B rail portions as well as a semicircular end portion 19C, both fore and aft, as shown in FIG. 3.

Each rail 19,20 has a plurality of roller brackets or carriers 21 mounted on it for travel. The carriers 21 include a roller 23 for supporting the carrier in the guide rail and allowing it to travel with the endless belt 15.

Springs 33,34 are connected between the carriers 21 and reinforced openings in the belt 15. The springs 33,34 are attached at two-spaced apart positions along the peripheral edges 17,18 of the belt 15. This arrangement places each spring 33,34 at an acute angle relative to the mat edges 17,18 of about 45 degrees and allows each spring to impart both longitudinal and lateral tension to the mat along its edge portions. The belt can be moved by the subject walking or running on the belt surface 15A or by a suitable motor connected to one of the roller assemblies 13, 14.

Figure 4:
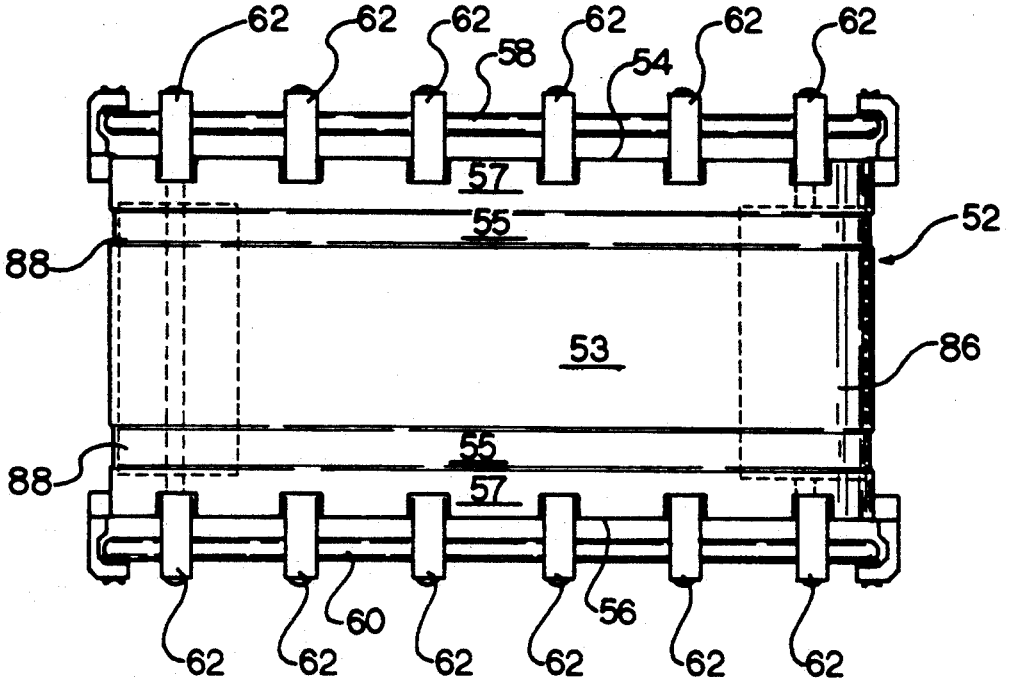
FIG. 4 is a top plan view of a treadmill with a belt which forms a trampoline-like surface manufactured in accordance with the present invention.
Figure 5:
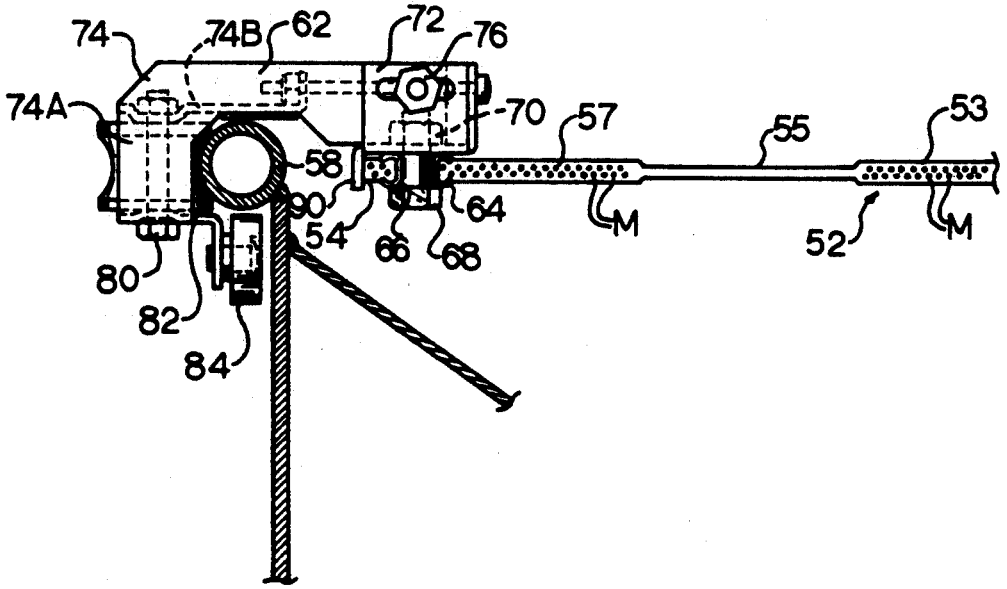
FIG. 5 is a partial sectional view of a belt made in accordance with the present invention, along with one of the carriers used to connect the belt to a guide rail.
Figure 6:
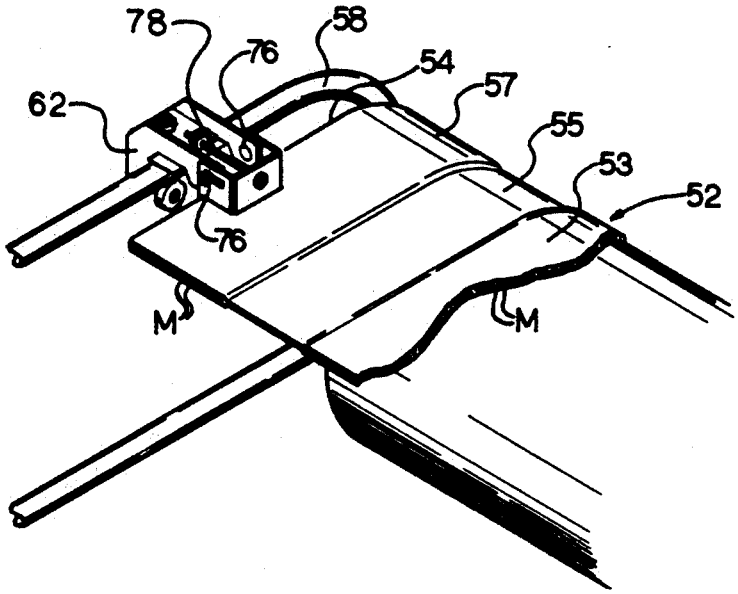
FIG. 6 is a perspective view of one of the carriers for connecting the belt to a rail as shown in FIG. 5.

FIGS. 4-6 illustrate a preferred embodiment of the improved belt formed in accordance with the invention. As shown best in FIG. 4, a belt 52 with lateral edges 54,56 is connected to support rails 58,60 by means of carriers 62 as described below. As shown, springs used in the prior art machine described above have been eliminated.

Instead, the belt 52 is formed with a center non-resilient section 53 bounded on both edges by resilient sections 55 which impart the resiliency which was provided by the springs in the prior art apparatus. An outer reinforced section 57 is located outside each resilient section 55 so that the lateral edges of the belt 52 can be connected to the carriers 62.

As shown best in FIGS. 5 and 6, the carriers 62 are connected to the reinforced outer sections 57 of the belt 52 through grommets 64 incorporated in openings 66 formed along the reinforced outer sections 57 of the belt 52. A bolt 68 extends from underneath the belt 52 and is held in place by a nut 70 shown by the dashed lines in FIG. 5. As shown in FIG. 4, a plurality of carriers 62 are connected to the belt 52 as described.

Each carrier 62 is formed of two sections 72,74 which are connected to each other through a pair of carrier bolts 76 (FIG. 6) which can be loosened in order to fix the distance between the guide rail 58 and the lateral edge 54 of the belt 52. A machine screw 78 is located between the sections 72,74 of the fixture 62 for adjusting the tension of the belt when used in conjunction with the carriage bolts 76.

The carrier section 74 is formed of two pieces, an outer frame 74A and an inner section 74B which provides for the inner bolt hole for a bolt 80, which connects the carrier section 74 to a roller 82 that engages the outer edge of the rail 58. The rollers 82 travel along the rail 58 as the belt 52 moves. A second roller 84 engages the bottom edge of the rail 58 to provide added stability to each carrier 62. One of the sections 72 of the carrier 62 is formed with a lip 90 which engages the lateral edge 54 of the belt 52 for added stability while the belt is moving.

As the belt 52 moves relative to the rails 58,60 which can be accomplished either by the walking or running action of the subject or by a suitable motorized drive (not shown), the carrier 62 will move along the rails 58 and 60 at a predetermined location to provide the proper tension in the mat 52. The ends of the mat 52 are supported by a roller drum 86 preferably located at the back end of the apparatus and a pair of roller supports 88 formed of pneumatic tires that are located at the front end of the apparatus.

If a drive means is to be used, it is preferably connected to one or both of the pneumatic rollers 88 which provide satisfactory frictional contact with the bottom surface of the belt 52 in order to drive the belt.

As shown best in FIGS. 5 and 6, a preferred embodiment of the belt is formed as a continuous web of laminated resilient material such as butyl rubber (not specifically shown), with one or more layers of a non-resilient material such as nylon mesh, represented by the sectional depiction of strands designated by letter M, which is incorporated between layers of resilient material in the reinforced sections. The belt is formed by laminating layers of butyl rubber and incorporating layers of nylon mesh between the layers of butyl rubber such that as the belt is formed the ends of the laminations are at different locations along the length of the belt so that when the belt is formed it is essentially seamless.

Figure 7:
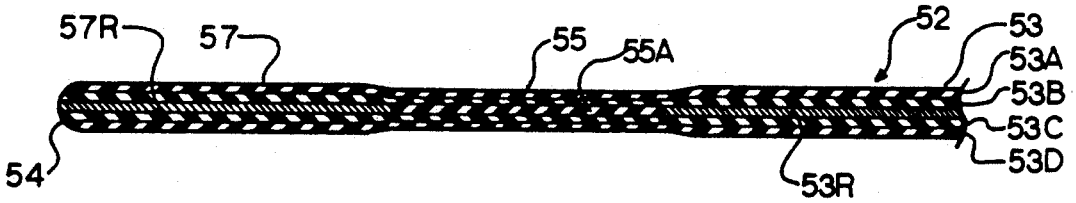
FIG. 7 is a partial sectional view of an alternative embodiment of a belt made in accordance with the present invention.

FIG. 7 illustrates an alternative embodiment of belt 52 in which the center non-resilient section 53 comprises a laminate of resilient layers 53A-D surrounding a reinforcing layer 53R. Resilient layers 53A-D extend through outer reinforced section 57 to the lateral edge of 54 of belt 52. Resilient layers 53A-D form a laminate with reinforcing layer 57R in outer reinforced section 57. Resilient section 55 comprises a laminate of resilient layers 53A-D surrounding resilient layer 55A.

As shown best in FIGS. 4-6, the resilient sections 56 are shown in exaggerated thinner dimension relative to the non-resilient sections which include the layers of nylon mesh. By providing a belt of this design, the springs shown in the prior art are eliminated which provides for fewer parts for the machine and obvious economic benefits. Further, with the type of belt that was used with the springs formed of a polypropalene material, that belt could not be heat sealed without losing resiliency, thereby requiring stitching to form an endless belt. This necessarily resulted in exposed seams which had a tendency to wear through after a predetermined period of use.

The laminated structure of the belt in the preferred embodiment also eliminates a stretching problem at the grommets which were caused by the springs working on the grommets as the belt moved along the rails. The flexible connection between the springs and the mat caused a stretching and potential tearing problem which has been eliminated by having a static connection between the carrier 62 and the mat, with the spring action being imparted by the built-in resilient sections of the mat.

Another advantage of the butyl rubber mat is that static electricity normally generated on the non-conductive surface of a polypropalene mat has been eliminated. With no springs, the overall weight of the machine has been substantially reduced and the noisy action of the springs as they traveled along with the carriers, especially along the curved ends of the machine, has been eliminated.

Also, with the springs located along the lateral edges of the belt, a space was provided which could be stepped into by the user. With the design of the present invention this space has been eliminated, thereby making the machine safer for use.

Figure 8:
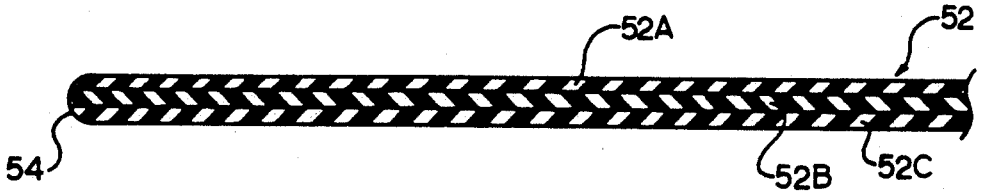
FIG. 8 is a partial sectional view of an additional alternative embodiment of a belt made in accordance with the present invention.

In another embodiment of the invention, instead of providing a belt 52 with resilient portions located between reinforced portions, the belt could be formed entirely of laminated butyl rubber with a resiliency inherent in the entire structure of the mat. This alternative embodiment is illustrated in FIG. 8 in which the laminated layers of belt 52 are designated by reference numerals 52A–C. Obviously, the design parameters for such a mat would be different from the one shown in FIGS. 4–6 because of the higher strength requirements for the laminated butyl rubber without the nylon mesh reinforcement. Other variations in design could also be used, with the important factor being to provide a belt which is formed of a material which is resilient across at least a portion of its width to provide the resiliency necessary without additional springs to impart a trampoline-like sensation to a subject walking or running on the belt.

In a preferred embodiment shown in FIGS. 4–6 of the invention, the belt has a total width of about 23½ inches with a length of 60 inches between the center lines of the roller supports 86,88, with the roller supports being about 11 inches in diameter. For such a belt, the reinforced outer edges 57 would be approximately 0.25 inches thick, the resilient unreinforced portions 55 about 0.12 inches thick and the reinforced, non-resilient center portion at about 0.18 inches thick. The belt would be formed entirely of laminated butyl rubber with reinforced sections including one or more layers of nylon mesh, as described above. The actual method of forming the belt of the preferred embodiment is considered to be a proprietary process of the Goodyear Tire & Rubber Company, Lincoln, Nebr.

By utilizing an improved belt as described above, the advantages discussed are imparted to the treadmill using such a trampoline-like surface. It should be understood that other improvements and modifications can be made to the invention without departing from the scope of the invention as set forth in the appended claims.

I claim:

1. A treadmill with an improved trampoline-like surface, comprising:

(a) an endless belt with generally parallel lateral edges, the upper surface of which is adapted to form an exercising surface;

(b) end-supporting members;

(c) support means for supporting the endless belt for travel between the end-supporting members;

(d) the support means including means spaced from the lateral edges of the belt for supporting the belt as it moves between the endsupporting members, there being no spring means between the belt and support means; and (e) the belt being formed of a material which includes means for imparting a lateral resiliency across at least a portion of the width of the belt to impart a trampoline-like sensation to a subject walking or running on the belt.

2. The belt of claim 1, wherein the belt is formed with a substantially non-resilient center section and substantially non-resilient section along each lateral edge, with a resilient section between said non-resilient sections.

3. The belt of claim 2, wherein the non-resilient sections are formed of at least one reinforcing layer laminated between layers of resilient material, and wherein the layers of resilient material extend continuously across the width of the belt.

4. The belt of claim 2, wherein the resilient section are formed of laminated layers of resilient material.

5. The belt of claim 3 or claim 4, wherein at least a substantial number of the layers of resilient materials are joined at different locations along the length of the belt so the belt is essentially seamless.

6. The belt of claim 3 or claim 4, wherein the resilient material includes butyl rubber.

7. The belt of claim 3, wherein the reinforcing layer includes a nylon mesh material.

8. The belt of claim 1, wherein the belt is resilient across its entire width.

9. The belt of claim 8, wherein the resilient material includes a plurality of layers of said material.

10. The belt of claim 8, wherein the resilient material is butyl rubber.

11. The treadmill of claim 1, and further including a series of reinforced openings spaced apart near the lateral edges of the belt;

the treadmill further including means for connecting the support means to the reinforced openings without the use of springs.

12. The treadmill of claim 1, wherein the support means includes a pair of guide rails spaced apart from the lateral edges of the belt.

13. The treadmill of claim 1, wherein the support means further includes roller supports located between the upper and lower surfaces of the belt at each end of the belt.

* * * * *

UNITED STATES PATENT AND TRADEMARK OFFICE

CERTIFICATE OF CORRECTION

PATENT NO. : 5,250,012

DATED : October 5, 1993

INVENTOR(S) : Jeffrey O. Meredith

It is certified that error appears in the above-indentified patent and that said Letters Patent is hereby corrected as shown below:

On the Title page, item [75], inventors: add R. Clayton Lee--.

Signed and Sealed this

Fifth Day of April, 1994

Bruce Lehman

*Attest:*

BRUCE LEHMAN

*Attesting Officer*

*Commissioner of Patents and Trademarks*